United States Patent [19]

Kruschel

[11] 4,275,584

[45] Jun. 30, 1981

[54] CRIMPING TOOL

[75] Inventor: William A. Kruschel, Oakdale, Minn.

[73] Assignee: Minnesota Mining and Manufacturing Company, St. Paul, Minn.

[21] Appl. No.: 70,684

[22] Filed: Aug. 29, 1979

[51] Int. Cl.[3] ..... B21D 7/06

[52] U.S. Cl. ..... 72/410; 81/9.1 R

[58] Field of Search ..... 72/409, 410, 399, 394; 81/9.1 R; 140/93.4; 29/243.56

[56] References Cited

U.S. PATENT DOCUMENTS

| | | | |
|---|---|---|---|
| 2,680,979 | 6/1954 | Childress | 81/9.1 R |
| 2,942,269 | 6/1960 | Austin | 72/409 |
| 3,166,960 | 1/1965 | Roessler | 81/9.1 R |
| 3,184,997 | 5/1965 | Rutty | 81/9.1 R |
| 3,200,675 | 8/1965 | Willis | 81/9.1 R |
| 4,111,022 | 9/1978 | Kruschel | 72/410 |

FOREIGN PATENT DOCUMENTS

| | | | |
|---|---|---|---|
| 671083 | 1/1939 | Fed. Rep. of Germany | 81/9.1 R |
| 1173016 | 6/1964 | Fed. Rep. of Germany | 81/9.1 R |

*Primary Examiner*—Nicholas P. Godici
*Assistant Examiner*—Gene P. Crosby
*Attorney, Agent, or Firm*—Cruzan Alexander; Donald M. Sell; William L. Huebsch

[57] ABSTRACT

A tool for crimping a sheet metal clasp around overlapped lengths of nonmetallic strapping material. The sheet metal clasp, after being placed around the strapping, is inserted into the tool which can then be operated to cause two lips on the clasp to fold over and constrict the clasp around the strapping material. The tool has two jaws, one of which is elongated, which facilitate this folding action. The elongated first jaw is positioned to fold over a first lip on the clasp prior to the other jaw folding the second lip. In this manner the second jaw can fold the second lip over the first lip thereby securing the clasp. The jaws of the tool are of a solid and unitary construction and are adapted to deform the clasp around the strapping to further strengthen the seal.

6 Claims, 9 Drawing Figures

CRIMPING TOOL

BACKGROUND OF THE INVENTION

This invention relates to tools for crimping sheet metal clasps around overlapped lengths of nonmetallic strapping material.

There are many tools available in the prior art for fastening overlapped lengths of strapping material by crimping a clasp around the overlapped lengths. One is the manually operated tool described in applicant's U.S. Pat. No. 4,111,022. That tool is well suited for crimping a nonsymmetric one-half inch clasp, available from 3M Company and designated the 315 clasp, around conventional non-metallic strapping material. Its mechanism does not, however, develop sufficient mechanical advantage so that it can be easily manually actuated to crimp the larger and stiffer clasps used to join and retain the recently developed five-eighths inch polyester strapping material.

SUMMARY OF THE INVENTION

According to the present invention there is provided a tool for firmly crimping the larger and stiffer sheet metal clasps around overlapped lengths of nonmetallic strapping material.

The tool comprises a frame in which is affixed a platen defining a generally planar support surface adapted to receive a sheet metal clasp; and two jaws, each jaw having an elongate body portion and a projecting ledge portion at one end which projects generally perpendicular to the body portion. The body portions of the jaws are pivotally mounted on the frame at opposite sides of the support surface with their projecting ledges in an opposed relationship so that the actuation of a pair of handles coupled to the jaws will move the jaws from an open position, where the jaws are spaced from each other and the support surface to allow the placement of a clasp on the support surface; to a closed position, with the ledge portions more closely adjacent to the support surface so that a clasp on the support surface of the platen will be engaged and crimped against the support surface by inner crimping surfaces of the ledge portions.

One of the jaws has a shorter projecting ledge portion than the other jaw so that during movement of the jaws from their open position to their closed position, the crimping surface of the longer ledge portion will engage and bend a top portion of the clasp over the overlapped lengths of strap, and the crimping surface of the second jaw will engage and bend a locking lip of the clasp over the distal edge of the top portion of the clasp.

Preferably the support surface of the platen and the crimping surfaces of the jaws are defined by the distal surfaces of parallel spaced ridges, with the ridges on the ledge portions of the jaw aligned with the spaces between the ridges on the platen and the ridges on the platen aligned with the spaces between the ridges on the ledge portions such that the ledge portions will transversely deform the clasp as the jaws close thus adding to the holding strength of the closed clasp.

DESCRIPTION OF THE DRAWING

This invention will be further described with reference to the accompanying drawing wherein like members refer to like parts in the several views, and wherein:

FIG. 9 illustrates an inverted view of the clasp of FIGS. 8 and 9 after it has been crimped around overlapped lengths of nonmetallic strapping material by the tool of FIG. 1.

DESCRIPTION OF THE PREFERRED EMBODIMENT

Figure 8:
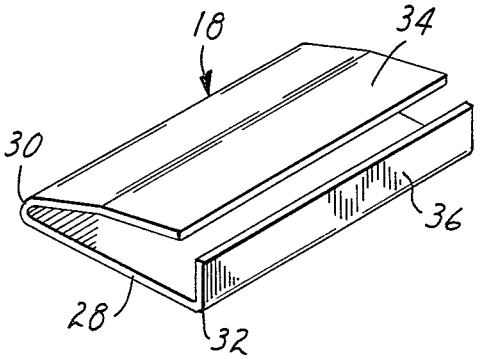
FIG. 8 PRIOR ART
FIGS. 8 and 9 illustrate a known prior art clasp of the type which the tool of FIG. 1 is designed to crimp.

Referring now to the drawing, there is illustrated a crimping tool according to the present invention generally designated by the numeral 10. The tool 10 is adapted for actuation via a pair of handles 12. Upon movement of the handles 12 from a spread to a parallel position, means for coupling the handles 12 to each other and to a pair of jaws 14 and 16 will cause the jaws 14 and 16 to move from an open position (FIG. 3) to a closed position (FIG. 6) so that a sheet metal clasp 18 (FIG. 8) positioned between a platen 20 on a frame 22 for the tool 10 and crimping surfaces 24 and 26 on the jaws 14 and 16 respectively when the jaws 14 and 16 are in their open position can be crimped around overlapped lengths of nonmetallic strapping material 27, as is sequentially illustrated in FIGS. 3, 4 and 6.

Figure 9:
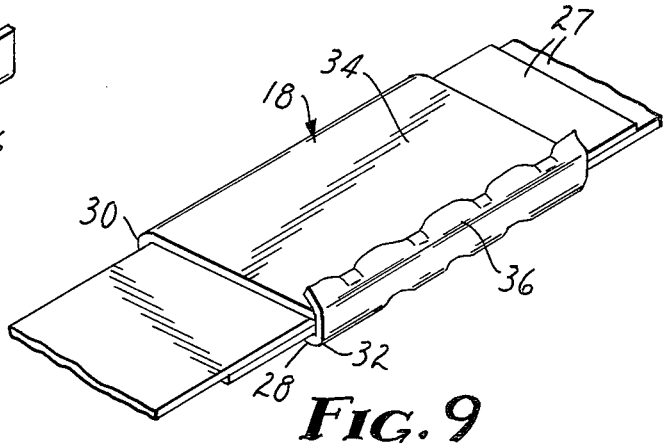
FIG. 9 PRIOR ART

The clasp 18 (FIG. 8) is of a known type such as the No. 715 clasp available from Minnesota Mining and Manufacturing Company, St. Paul, Minn., which includes a generally planar base portion 28 having a serrated inner surface with a width between parallel edges 30 and 32 corresponding generally to the width of the lengths of strapping material 27 to be joined. The clasp 18 also includes an elongate top portion 34 with a serrated inner surface joining the base portion 28 along the parallel edge 30. The top portion 34 projects over the base portion 28 in a spaced relationship to afford positioning overlapped lengths of strapping material 27 therebetween, and is adapted to overlap the base portion 28 when pressed over the lengths of strapping material 27 thereon (FIG. 9) with a distal edge of the top portion 34 along the parallel edge 32. Also included in the clasp 18 is a short locking lip 36 projecting generally perpendicular to the base portion 28 toward the top portion 34 along the edge 32 and having a height affording engagement thereof over the distal edge of the top portion 34 (FIG. 8) after the top portion 34 is pressed over lengths of strapping material 27 between the top portion 34 and the base portion 28.

The frame 22 for the tool 10 is generally U-shaped, having parallel planar side walls 40 joined by a bottom wall 42. The platen 20 is fixed between the side walls 40 adjacent their end opposite the bottom wall 42 by a pair of parallel spaced pins 43, and includes on its side opposite the bottom wall 42 a plurality of elongate shaped parallel ridges 44 extending generally parallel to the side walls 40 and having distal surfaces which define a generally planar support surface 46 that is adapted to support the base portion 28 of the clasp 18.

The jaws 14 and 16 each have an elongate body portion 48 or 50 and a ledge portion 52 or 54 projecting generally perpendicularly from the side of the body portion 48 or 50 at one of its ends. The body portions 48 and 50 of the jaws 14 and 16 are each mounted at about their midpoints between the side walls 40 of the frame 22 for pivotal movement about the pins 43, with their projecting ledge portions 52 and 54 opposed (i.e., with the most distal portions of their ledge portions 52 and 54 and facing each other) so that the jaws 14 and 16 can move from their open position where the ledge portions 52 and 54 are most distant from each other to afford the positioning of the jaws 14 and 16 around a clasp 18 in which are disposed overlapped lengths of strapping material 27; and their closed position where the distal ends of the ledge portions 52 and 54 are touching or almost touching, and the inner surfaces of the ledge portions 52 and 54 are sufficiently closely adjacent the platen 20 that the clasp 18 will be crimped therebetween. The ledge portion 52 of the jaw 14 (designated the first or long jaw herein) projects farther than the ledge portion 54 of the jaw 16 (designated the second or short jaw herein) so that during movement of the jaws to their closed position the ledge portion 52 of the first jaw 14 (which is about 1½ times the length of the ledge portion 52 of the second jaw 16) will contact and bend an adjacent top portion 34 on a clasp 18 having its base portion 28 supported on the platen 20 to a position about parallel with the base portion 28 before the ledge portion 52 on the second jaw bends the locking lip 36 over, even though the jaws 14 and 16 are pivoted toward each other at the same rate of speed. This results in the locking lip 36 being bent over the distal edge of the top portion 34 to lock the top portion 34 in place.

Each of the projecting ledge portions 52 and 54 includes on its inner side a series of parallel spaced ridges 60 and 62 extending generally perpendicular to the attached body portion 48 and 50. The distal surfaces of the ridges 60 and 62 define generally planar inner crimping surfaces for the ledge portions 52 and 54 respectively for contacting the top portion 34 and locking lip 36 of the clasp 18 to bend them parallel to the base portion 28 of the clasp as the jaws 14 and 16 close. The ridge 60 and 62 are aligned with the spaces between the ridges 44 on the platen 20 and the ridges 44 on the platen 20 are aligned with the spaces between the ridges 60 and 62 on the jaws 14 and 16 so that the ridges 44, 60 and 62 will transversely deform the clasp 18 and give it a slight undulating shape along its length when the jaws 14 and 16 close to more firmly hold the strapping material 27 within the clasp 18.

The means for coupling the handles 12 to each other and to the pair of jaws 14 and 16 comprises a pair of pivot pins 66, each one of which pivotably couples one end of each of the handles 12 and the end of the corresponding jaw 14 or 16 opposite its ledge portion 52 or 54; and a coupling pin 68 pivotably coupling together the ends of the handles 12 adjacent the pivot pins 66 so that manual force applied to press the handles 12 together will be transferred to the jaws 14 and 16 via the pivot pins 66. The coupling pin 68 has projecting end portions on which are positioned sliding members 69 slidably guided along slots 70 in the frame 22 to ensure that the jaws 14 and 16 will move along the same path relative to the frame 22 between their open and closed position. The slots 70 extend perpendicular to the support surface 46 on the platen 20 so that the jaws 14 and 16 will pivot through corresponding arcs between their open and closed positions.

Figure 1:
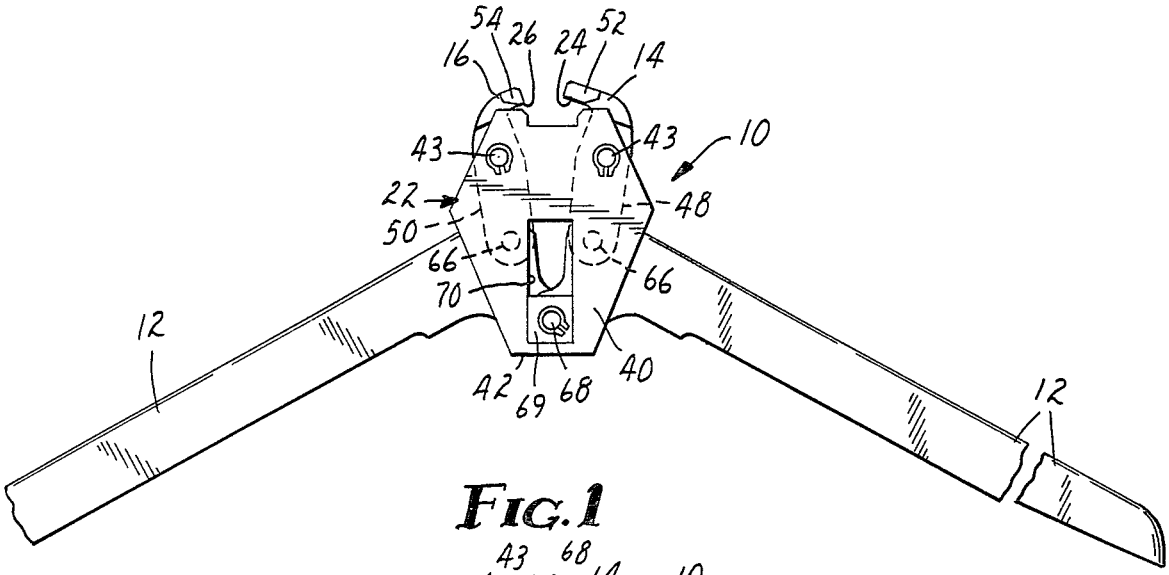
FIG. 1 is a fragmentary side view of a clasp crimping according to the present invention.
Figure 2:
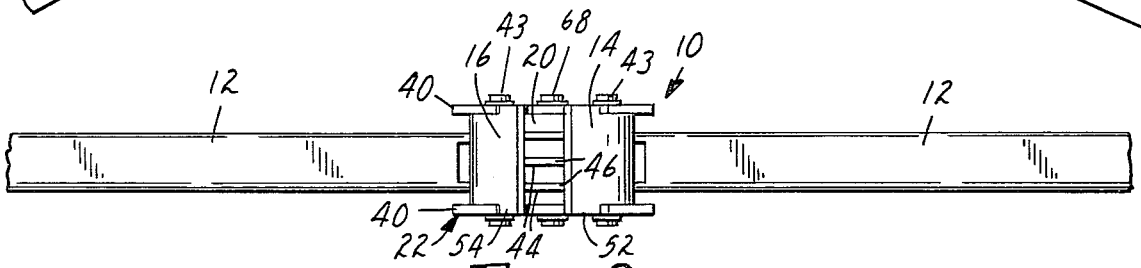
FIG. 2 is a fragmentary top view of the tool of FIG. 1.
Figure 3:
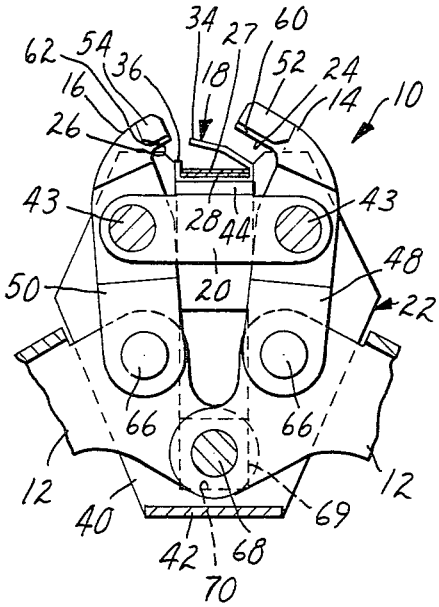
FIGS. 3, 4, and 6 are enlarged fragmentary views which sequentially illustrate the crimping of a clasp by the tool of FIG. 1, with FIGS. 3, 4, and 6 having parts broken away to show details.
Figure 4:
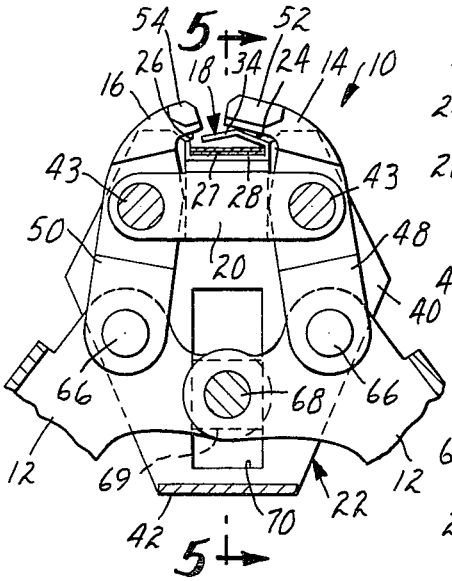
Figure 5:
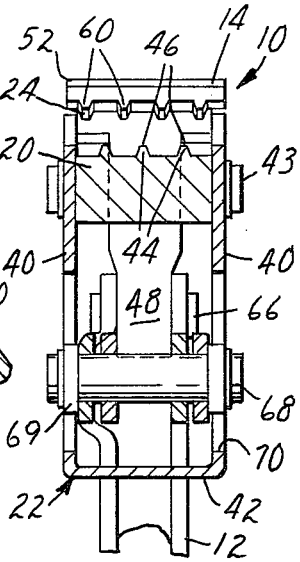
FIGS. 5 and 7 are fragmentary sectional views of FIGS. 4 and 6 taken along lines 5—5 and 7—7 respectively.
Figure 6:
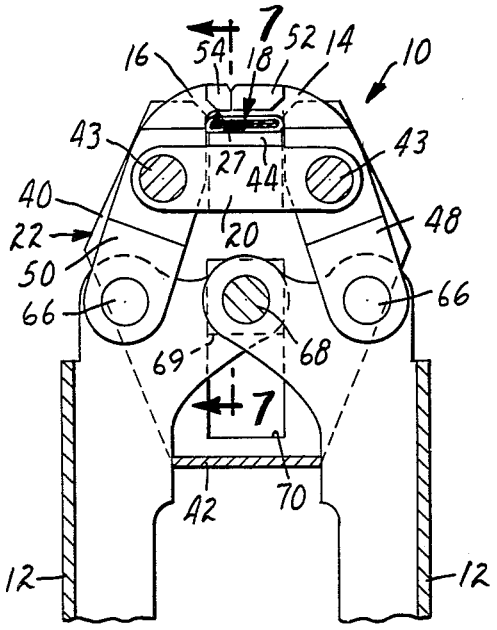
Figure 7:
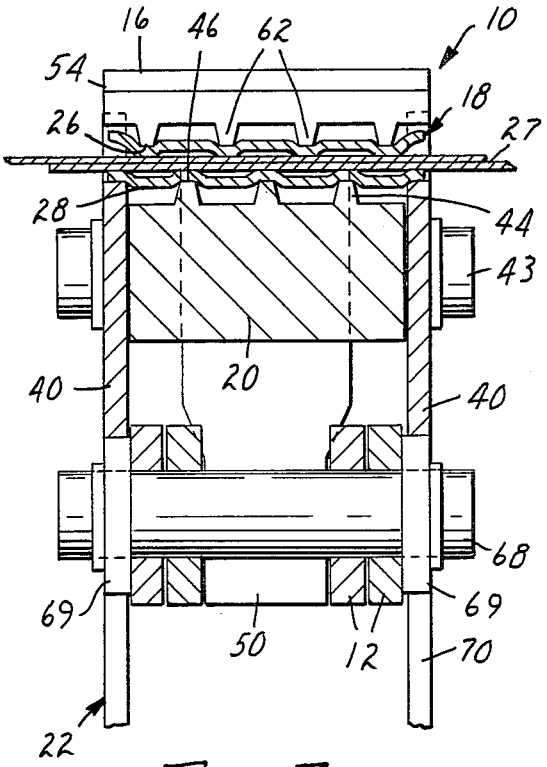

To engage a clasp 18 with overlapped ends of a length of strapping material 27 extending around some object, an operator first places the clasp 18 around the overlapped ends with the top portion 34 of the clasp 18 toward the object being strapped. The operator then opens the jaws 14 and 16 of the tool 10 by separating the handles 12, and places the jaws 14 around the clasp 18 with the base portion 28 of the clasp against the support surface 46 on the platen 20 and the first long jaw 14 adjacent the top portion 34 and the clasp 18 (FIG. 3). The operator then pushes the handles 12 together, causing the jaws 14 and 16 to move to their closed position and the clasp 18 to be crimped between the closing jaws 14 and 16 on the platen 20. During movement of the jaws 14 and 16 to their closed position, the projecting ledge portion 52 on the first jaw 14 contacts the top portion 34 of the clasp 18, causing it to fold over the strapping material 27 (FIG. 4). Also, the ledge portion 54 on the second jaw 16 contacts the short locking lip 36 of the clasp 18, causing it to fold over after the top portion 34 has been folded against the strapping material 27 so that the locking lip 36 is folded over the distal edge of the top portion 34 and holds the top portion 34 in place. As the closing of the jaws 14 and 16 continues, the jaws 14 and 16 constrict the clasp around the strapping material 27 as is illustrated by FIGS. 6 and 7. Not only are the portions 28, 34 and 36 of the clasp pressed together due to the spacing between the crimping surfaces 24 and 26 of the jaws 14 and 16 and the support surface 46 of the platen 20, but the clasp 18 is also transversely deformed by the interdigitated ridges 60, 62, and 44 of the jaws 14 and 16 and the platen 20, resulting in an undulating pattern on the crimped clasp 18 (See FIGS. 7 and 9) so that the crimped clasp firmly grasps the overlapped strapping material 27 while not cutting into its surface.

As a nonlimiting example, one manually activated tool 10 according to the present invention which requires less than 50 pounds force to close the handles and complete the crimping of the clasp 18 (thus enabling the operator to repetitively perform this crimping function) has the following dimensions. The ledge portion 52 projects 13.6 mm. and the ledge portion 54 projects 5.3 mm. The distance from the adjacent ledge portion 52 or 54 to the adjacent pin 43 is 0.447 cm. The distance from each of the pins 43 to the adjacent pivot pin 66 is about 1.062, and the length of each of the handles is about 47 cm.

The above description is a preferred embodiment of the present invention. It will be understood that changes may be made in the relative sizes, shapes, or configurations of some of the parts without departing from the spirit of the present invention as defined in the appended claims.

What is claimed is:

1. A tool for crimping sheet metal clasps around overlapped lengths of nonmetallic strapping material, said tool comprising:

a frame;

a platen affixed to said frame including a plurality of parallel ridges, said ridges having spaces therebetween and distal surfaces defining a generally planar support surface adapted to support a base portion of a said sheet metal clasp;

first and second jaws, each of said jaws having an elongate body portion and a projecting ledge portion at one end projecting generally perpendicular to said body portion, said second jaw having a substantially shorter projecting ledge portion than said first jaw, said ledge portions each including a plurality of parallel ridges extending generally parallel to said ledge portion, said ridges having spaces therebetween and distal surfaces defining a generally planar inner crimping surface for the ledge portions, the body portions of said jaws being pivotably mounted on said frame on opposite sides of said support surface with said projecting ledges in opposed relationship for movement between an open position with said jaws spaced from each other and said support surface to afford positioning a base portion of a sheet metal clasp on said support surface with a top portion of the clasp adjacent said first jaw and a locking lip of the clasp adjacent said second jaw, and a closed position with said ledge portions proximate to each other and more closely adjacent said support surface, such that the crimping surface of said first jaw will engage and bend the top portion of the clasp over the overlapped lengths of strapping extending through the clasp, and the crimping surface of said second jaw will engage and bend the locking lip of the clasp over the distal edge of the top portion of the clasp, said ridges on said ledge portions being aligned with said spaces on said platen and said ridges on said platen being aligned with said spaces on said ledge portions to transversely deform the clasp upon movement of said jaws to their closed position;

a pair of elongate handles, means mounting said handles for pivotal movement relative to each other and for pivotally coupling said handles to said jaws to afford moving said jaws from their open to their closed position.

2. A crimping tool as described in claim 1 wherein said means mounting said handles includes guide means on said frame coupled to said handles for ensuring a constant path relative to said frame for the movement of said projecting ledges between open and closed positions.

3. A crimping tool as described in claim 1 wherein said means mounting said handles includes a coupling pin pivotably connecting said handles and a sliding member attached to said hinge pin, said frame has a slot extending generally perpendicular to said support surface, and said sliding member is slideably engaged in said slot.

4. A crimping tool for crimping sheet metal clasps around overlapped lengths of nonmetallic strapping material, said tool comprising a frame, a pair of handles, means mounting said handles for pivotal movement relative to each other and said frame, a pair of jaws pivotally mounted in said frame for movement between an open position affording the insertion of said lengths of strapping and a clasp which is to be crimped around said strapping, and a closed position where said jaws essentially constrict the clasp around said strapping, means pivotally coupling said handles to said jaws; said tool further comprising a stationary platen affixed to said frame, said platen and said frame being adapted to receive said lengths of strapping and clasp when said jaws are in said open position, and wherein said jaws are of a one-piece construction having a projecting ledge disposed to contact and fold over the clasp during the closing of said jaws, one of said projecting ledges being elongated so as to contact the clasp prior to the other of said ledges, thereby causing the side of said clasp first contacted to fold over due to the force exerted by said elongate jaw prior to the side of said clasp secondly contacted by said other jaw.

5. A crimping tool as described in claim 4 wherein said other of said ledges being shorter than said elongate ledge is adapted to contact the clasp only after the elongate ledge has folded over the first contacted side of the clasp, thereby causing the second contacted side of the clasp to fold over the first.

6. A crimping tool as described in claim 4 wherein the inner surface of said ledges are defined by a series of ridges spaced apart from and parallel to each other, and wherein the surface of said platen is adapted to include a series of projecting ridges also spaced apart from and parallel to each other and further disposed such that said ridges of said platen are aligned with said spaces between the ridges of said jaws and said ridges of said jaws are aligned with said spaces between the ridges of said platen, thereby affording an irregular surface to deform said clasps as said jaws move from their open to their closed position.

* * * * *